US005802740A

United States Patent [19]

Merk, Sr.

[11] Patent Number: 5,802,740

[45] Date of Patent: Sep. 8, 1998

[54] INSULATED AND WATERPROOF SHOE

[76] Inventor: Erik E. Merk, Sr., P.O. Box 30148, Portland, Oreg. 97230-1027

[21] Appl. No.: 754,114

[22] Filed: Nov. 19, 1996

Related U.S. Application Data

[63] Continuation of Ser. No. 432,302, May 1, 1995, abandoned.

[51] Int. Cl.[6] ..... A43B 23/07

[52] U.S. Cl. ..... 36/55; 36/10; 36/83

[58] Field of Search ..... 36/10, 45, 55, 36/83, 93, 4

[56] References Cited

U.S. PATENT DOCUMENTS

| | | | |
|---|---|---|---|
| 2,329,209 | 9/1943 | Manson et al. | 36/55 |
| 3,350,795 | 11/1967 | Schlecht | 36/55 |
| 4,599,810 | 7/1986 | Sacre | 36/55 |
| 4,706,316 | 11/1987 | Tanzi | 36/55 |
| 4,777,740 | 10/1988 | Akagi | 36/55 |
| 4,819,345 | 4/1989 | Mulcahy et al. | 36/55 |

FOREIGN PATENT DOCUMENTS

| | | | |
|---|---|---|---|
| 298360 | 6/1988 | European Pat. Off. | 36/55 |
| 4000156 | 7/1991 | Germany | 36/55 |
| 3000837 | 1/1993 | WIPO | 36/55 |

*Primary Examiner*—M. D. Patterson
*Attorney, Agent, or Firm*—Olson & Olson

[57] ABSTRACT

A shoe having an upper, an outsole, a midsole, and an insole. An insulating sock-type liner is fitted within the shoe, having a suspended connection to an upper portion of the shoe and a cemented connection to each of the midsole and insole. The insulating liner is capable of combination with a sock-type waterproofing liner that fits within the insulating liner. The insulating liner has a bottom extension relative to the waterproofing liner for securement to the midsole under the insole. Also, the insulating layer has a front cut-out portion that allows flexing of the shoe as well as a person's foot.

5 Claims, 2 Drawing Sheets

INSULATED AND WATERPROOF SHOE

This application is a continuation of application Ser. No. 08/432,302 filed May 1, 1995, now abandoned.

BACKGROUND OF THE INVENTION

This invention relates to improvements in shoe constructions and is more particularly concerned with a shoe that is equipped with special insulation for use in intensely cold temperatures and which also is waterproof.

Shoes have heretofore included insulation for adding warmth to the feet of the wearer. Such insulation is combined with the upper of the shoe either between leather layers in the upper or on the inside surface thereof. Such insulation adds materially to the complexity of manufacture of the shoe in view of the bulkiness of the walls of the upper. Such bulkiness also often interferes with putting the shoes on or taking them off including lacing them at the tongue portion.

Shoes have also heretofore been made waterproof by various constructions. One such construction is shown in U.S. Pat. No. 4,599,810 wherein a waterproof sock-like liner is fastened within a shoe. This liner is constructed of a product that comprises a thin sheeting of thermoplastic resin substance that in its manufacture has the characteristic that makes it impervious to water but pervious to vapors such as perspiration vapors. A product with such features is on the market, identified by the trademark Gore-Tex and manufactured by W. L. Gore and Associates, Inc. The Gore-Tex layer is sandwiched between protective layers of abrasion resistant, rugged and porous material. The layer next to the foot has a surface texture which insures foot comfort. Such prior liner provides waterproofing and some insulation but it does not contribute appreciably to sufficient foot warmth for use in frigid or intensely cold weather.

SUMMARY OF THE INVENTION

An object of the invention is to provide an insulation for a shoe which takes the shape of a sock-type liner that has novel construction contributing to efficiency in manufacture as well as contributing to the comfort of the wearer and flexing with the movements of the foot.

Another object of the invention is to provide a shoe insulation of the type described which by means of its novel construction can be combined with a waterproofing sock-type liner whereby to serve an insulation function without interfering with the waterproofing function.

Another object is to provide a sock-type shoe insulation liner that combines in a novel manner with a waterproofing sock-type liner in a structure that insulates against frigid or intensely cold temperatures.

In carrying out the objects of the invention, the shoe comprises an upper for receiving the foot of a person and a sole secured to the upper. An insulating liner is suspended from an upper portion of the shoe upper and is secured at the bottom to the sole. The sole of the shoe comprises a midsole and an insole supported on the midsole. For efficient structure in the assembly, the bottom of the insulating liner is cemented to a top surface of the midsole and to an undersurface of the insole. A front portion of the insulating liner has a front cutout in the area of the shoe tongue whereby such liner will not interfere with the flexing of the tongue portion. The insulating layer is capable of enclosing a waterproofing liner to provide a combined waterproof shoe and one that will withstand frigid or intensely cold temperatures.

The invention will be better understood and additional objects and advantages will become apparent from the following description taken in connection with the accompanying drawings.

DETAILED DESCRIPTION OF A PREFERRED EMBODIMENT

Figure 1:
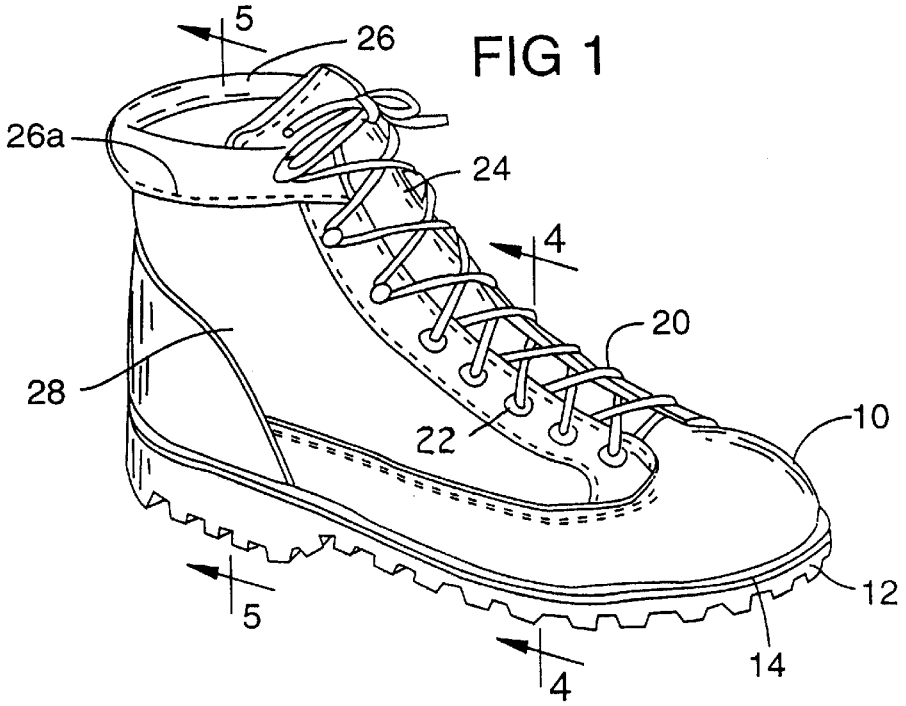
FIG. 1 is a perspective view of a commonly made shoe, such as a boot, in which the present invention can be combined.
Figure 4:
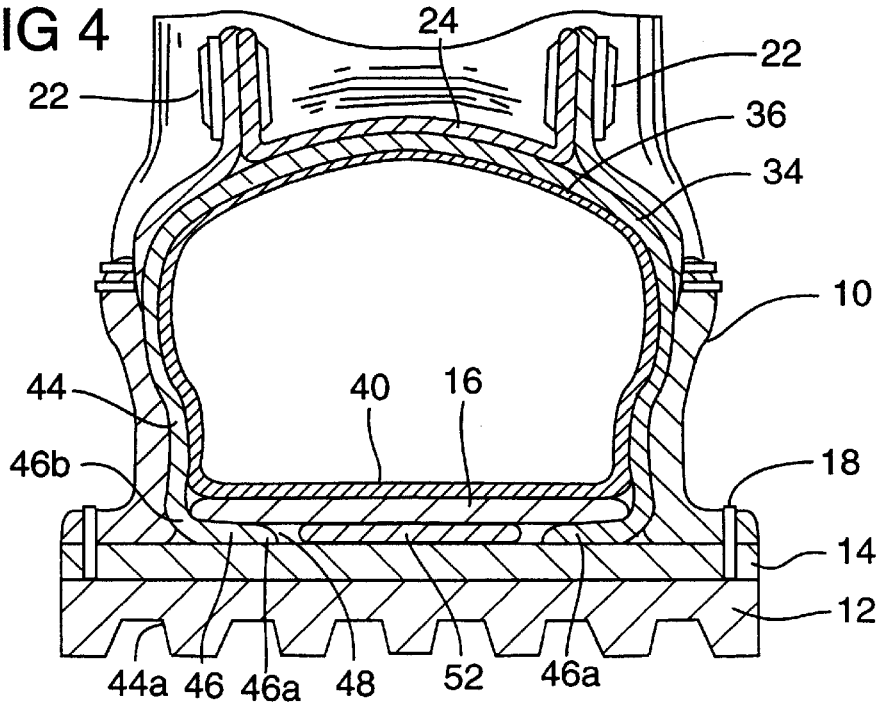
FIG. 4 is a section view, partially diagrammatic, taken on the line 4—4 of FIG. 1.
Figure 5:
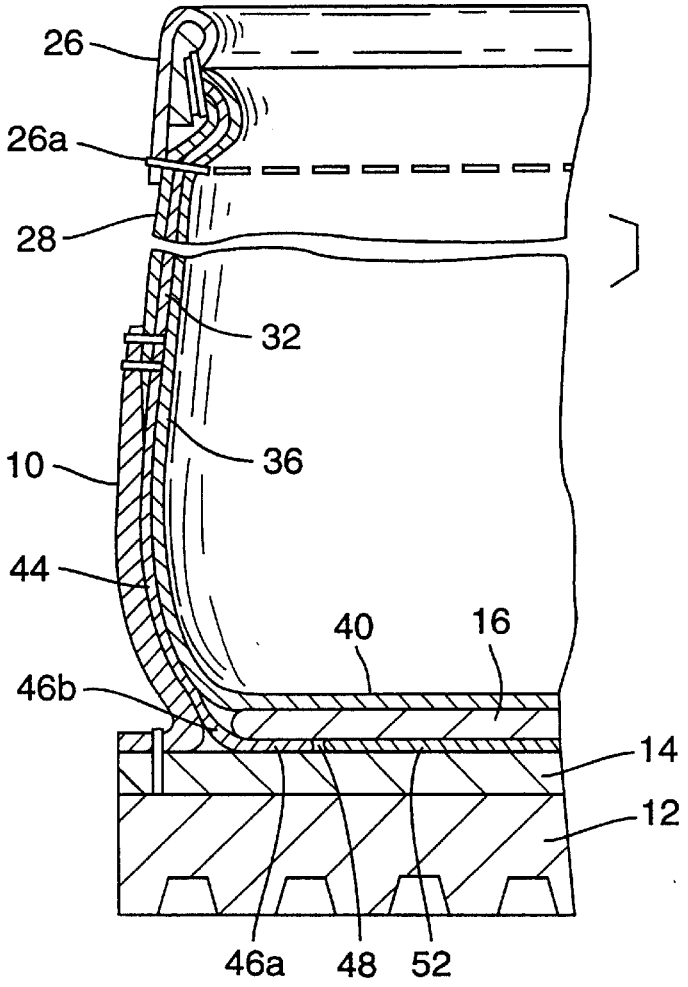
FIG. 5 is a section view taken on the line 5—5 of FIG. 1.

With reference to the drawings and first to FIG. 1, the present invention is designed for use with shoe constructions having a foot receiving upper 10, an outsole 12, also seen in FIGS. 4 and 5, a midsole 14, and an insole 16. The midsole is suitably secured, as by cement, to the outsole and the upper 10 is suitably secured to the midsole, as by stitching 18. Front lacing 20 is usually employed and has engagement in eyelets 22. The shoe also has a tongue portion 24 secured at its sides to the shoe and provided with fold portions, not shown, which allow for expansion and contraction of the upper for insertion and removal of the foot and for lacing the upper firmly to the foot. A connecting bead 26 is doubled over at the top of the upper and secured in place by stitching 26*a*. The shoe may or may not have a cosmetic side panel 28. If it does, such panel will also be secured by stitching.

Figure 2:
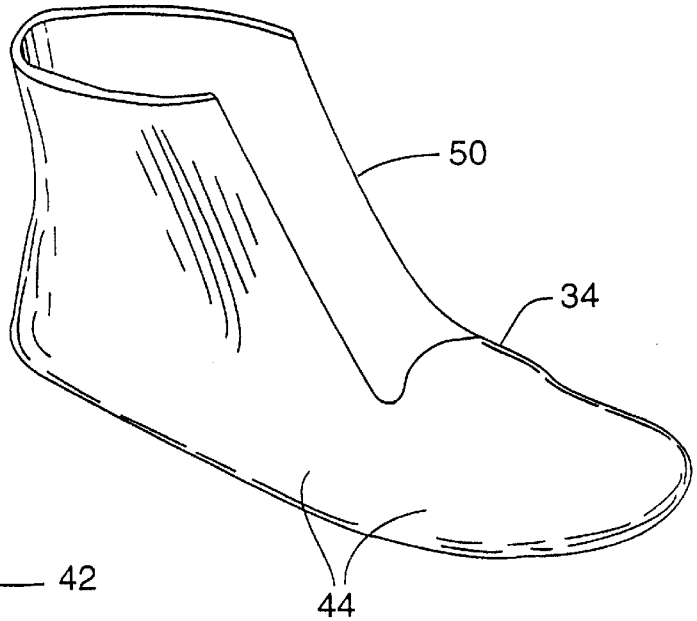
FIG. 2 is a perspective view of a sock-type liner for the shoe that comprises an insulation liner of the invention.
Figure 3:
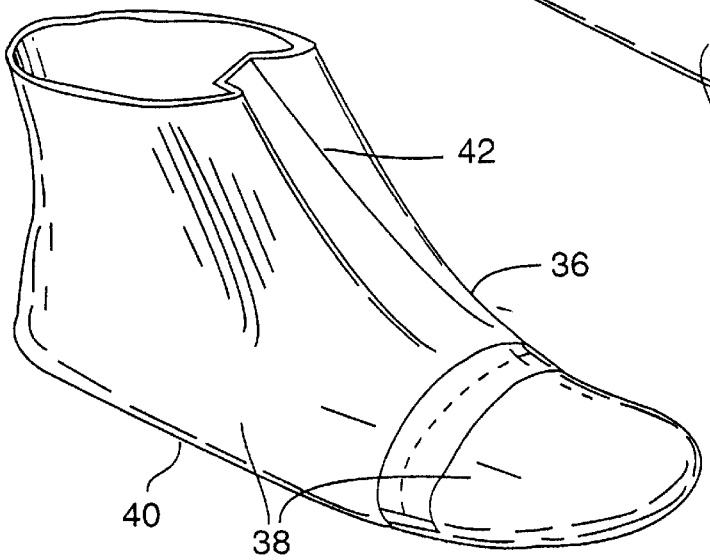
FIG. 3 is a perspective view of a shoe liner that comprises a waterproofing liner heretofore known by U.S. Pat. No. 4,599,180.

The invention is concerned with an insulation sock-type liner 34, FIGS. 2, 4 and 5, and also with this liner in combination with a waterproofing liner 36, FIGS. 3, 4 and 5. The waterproofing liner 36 is constructed of a waterproof fabric, for example, a material sold under the trademark "Gore-Tex" by W. L. Gore and Associates, and has a sock-type structure with full side, front, rear and toe walls 38 and a full bottom wall 40. The top of the liner 36 is open, and the front thereof at the instep portion has pleats 42 to allow for expansion and contraction of this liner with the tongue 24 of the shoe. A liner of the type illustrated in FIG. 3 is shown in U.S. Pat. No. 4,599,810.

The insulation liner 34 is also a sock-type liner constructed of an insulation layer that is suitable to protect the feet of the wearer against frigid and intensely cold temperatures. The liner has full side, rear and toe walls 44, a partial bottom wall 46, and an open top. The partial bottom 1wall 46 is formed by inturned portions 46*a* that extend fully around the sides, front, rear and toe walls 44. This partial bottom wall forms a bottom opening 48 in the liner. The insulation liner is only slightly larger in overall dimension than the waterproofing liner 36 so as to snugly receive it. The inturned edges 46*a* extend under the insole 16 in the construction of the shoe, to be described. The instep portion 50 of the liner 34 is cutaway. This cutaway portion extends from the instep of the toe of the liner and opens through the top of the liner. It is substantially the width of the shoe tongue. Such cutaway portion is provided to eliminate resistance to flexing of the pleats 42 of the liner 36 and the shoe tongue 24 when putting the boot on or taking it off, as will be more apparent hereafter.

With the liners properly lasted for insertion in a shoe, FIGS. 4 and 5, and assuming that the liners are fitted together. The bottom inturned portions 46*a* of the sides, rear and top walls of the insulation liner 34 are cemented to the top surface of the midsole 14. A shank 52 is supported on the midsole 16 in the opening 48. The insole 16 is cemented on top of the inturned liner portions 46*a* and on the shank 52. In turn, the full bottom wall of the waterproofing liner 36 is cemented to the top of the insole.

The two liners are secured commonly to an upper portion of the shoe, as apparent in FIG. 5, namely, they are secured under the top doubled over bead 26. The only points of connection of the composite liner assembly comprises its stitched connection to the top bead 26 which is above desired waterproof portions of the shoe, and to the midsole which comprises an adhesive, non-stitched waterproof connection. Although stitching at the bead 26 is preferred, such can efficiently be done by adhesive, or suspension in the shoe can be by other means.

Although it is preferred that the insulation liner be used with the waterproofing liner, it is to be understood that the insulation liner could be used apart therefrom. In such case, the insulation liner can similarly be suspended as an independent member from the upper portion of the shoe and be supported on the midsole and cemented to the underside of the insole, as shown.

The insulation liner is constructed of material and/or thickness that will protect the foot against frigid or intensely cold temperatures. With present day insulation material, the thickness and flexibility of the liner can be minimized for comfort in wearing of the shoe. The cutaway portion 50 at the front of the insulation liner allows normal flexing of the shoe tongue so that this liner does not interfere with flexibility of the shoe.

The combination of the insulation layer with the shoe in its suspension from the upper part of the shoe and the manner of securement to the sole portion provides an insulated shoe that is simplified in structure and manufacture. Such is also true when combined with the waterproofing layer.

It is to be understood that the forms of my invention herein shown and described are to be taken as preferred examples of the same and that various changes in the shape, size and arrangement of parts may be resorted to without departing from the spirit of my invention, or the scope of the subjoined claims.

Having thus described my invention, I claim:

1. In combination with a shoe construction of the type having an upper, an outsole, a midsole on the outsole, and an insole on the midsole, a first sock-type liner of waterproofing material, a second sock-type liner of insulating material capable of protecting the feet of a wearer against cold temperatures, said first liner being enclosed in said second liner, said second liner being only slightly larger in overall dimension than said first liner so as to snugly receive it, said first and second liners fitting closely within and suspended from an upper portion of the upper of the shoe, and means for securing the bottom portion of the first liner directly to and in contact with an upper surface of the insole, and upper and lower surfaces of bottom portions of the second liner directly to and in contact with a lower surface of the insole and an upper surface of the midsole, respectively.

2. The combination of claim 1 wherein said waterproofing liner has a bottom surface cemented to an upper surface of the insole and said insulating liner has upper and lower surfaces cemented respectively to a lower surface of the insole and an upper surface of the midsole.

3. The combination of claim 1 wherein said insulating liner has extensions around a lower portion thereof that fit under the insole and are cemented thereto and to the midsole.

4. The combination of claim 1 wherein said insulating liner has extensions around a lower portion thereof that fit under the insole and are cemented thereto and to the midsole, said extensions forming a bottom wall with a central opening, and a shank member supported on said midsole within said central opening.

5. A shoe construction comprising an upper capable of receiving the foot of a person and having an open bottom, a midsole secured at its upper side to the bottom side of the periphery of said upper, a ground-engaging sole secured at its upper side to the bottom side of said midsole in face-to-face contact, an insulating liner in said upper, the liner being capable of protecting the feet of a wearer against cold temperatures, the liner having an open bottom portion, a shank member supported on the midsole within the open bottom of the liner, means suspending said liner from an upper portion of said shoe upper, means securing a bottom portion of said insulating liner directly to and in contact with a top surface of said midsole, an insole within said liner secured to the upper surface of said liner, a waterproofing liner in said insulating liner, the insulating liner being only slightly larger in overall dimension than the waterproofing liner so as to snugly receive it, means suspending said waterproofing liner from an upper portion of said shoe upper, and means securing the bottom of said waterproofing liner directly to the top surface of said insole.

* * * * *